US005655321A

United States Patent [19]

Chang

[11] Patent Number: 5,655,321

[45] Date of Patent: Aug. 12, 1997

[54] WATER BALL STRUCTURE

[76] Inventor: Chih-Ping Chang, No. 112, Lane 1008, Ming Hu Road, Hsinchu City, Taiwan

[21] Appl. No.: 624,787

[22] Filed: Mar. 27, 1996

[51] Int. Cl.[6] ..... G09F 19/08

[52] U.S. Cl. ..... 40/409; 40/414; 40/430; 446/357; 446/267

[58] Field of Search ..... 40/409, 410, 411, 40/414, 427, 429, 430; 472/27, 28, 29; 446/357, 265

[56] References Cited

U.S. PATENT DOCUMENTS

| | | | |
|---|---|---|---|
| 3,768,199 | 10/1973 | Goldfarb | 446/357 |
| 5,134,795 | 8/1992 | Wang | 40/411 |
| 5,458,012 | 10/1995 | Liu | 40/409 |

*Primary Examiner*—Kenneth J. Dorner
*Assistant Examiner*—Cassandra Davis
*Attorney, Agent, or Firm*—Notaro & Michalos PC

[57] ABSTRACT

A water ball structure includes a base defining a cylindrical housing to received therein a music box type driving device and support thereon a water ball. The driving device is fixed on a disk which is received within a bottom opening of the housing and snap-held by resilient paws formed on the housing. A circumferential wall is provided to fix to and concentrically surround the housing. A rotation ring is supported on the circumferential wall by a ball bearing arranged on the top of the wall so as to allow the rotation ring to be rotatable relative to the housing in a concentric manner by being driven by the driving device through a gear train coupling therebetween. A toothed ring is fit over the housing and snap-held by paws provided on the housing. A number of motion generation devices are provided on the rotation ring, each having a first gear rotatably supported by an output shaft on the rotation ring and a second gear mating between the first gear and the toothed ring so that when the rotation ring rotates about the cylindrical housing, the output shaft of the first gear generates a rotation output through the engagement of the second gear with the toothed ring. A ball support collar is fit into the housing and snap-held by paws formed on the housing to support the water ball.

17 Claims, 10 Drawing Sheets

WATER BALL STRUCTURE

FIELD OF THE INVENTION

The present invention relates to a decorative article and in particular to a water ball structure with movable dolls supported thereon.

BACKGROUND OF THE INVENTION

Water balls or crystal balls have been widely used as indoor decoration for its low cost and beauty. The water balls nowadays not only provide a "static decoration", but also incorporates therein music and light generation device, as well as movable dolls. Such a water ball has a sophisticated structure and requires a number of parts assembled together in a complicated manner and would thus present at least the following disadvantages:

(1) The complication of assembling the water balls with the great number of parts increases with the number of the parts and fastening means, such as adhesives, bolts, screws or the like is needed to hold the parts together.

(2) It takes much time and labor to complete the assembly.

(3) Due to the complicated assembly process, it is often to damage or mis-assemble the parts during the assembly process and thus increasing the overall cost.

(4) The price would be high due to the substantial cost needed to manufacture the sophisticated structure.

(5) The overall service life would be short due to the great number of parts and the sophistication of the structure.

Thus, it is desirable to provide a water ball structure that possesses the same decorative and amusing function as the prior art, but is simple in structure and easy to manufacture.

SUMMARY OF THE INVENTION

The principal object of the present invention is to provide a water ball structure to overcome the drawbacks of the prior art.

It is another object of the present invention to provide a water ball structure which can be easily assembled without the use of adhesive or bolts or screws.

It is a further object of the present invention to provide a water ball structure which can assembled in a very short period of time by adapting a simplified assembly process as compared to the prior art.

It is a further object of the present invention to provide a water ball structure which has low manufacturing cost and thus a high market competitivity.

It is a further object of the present invention to provide a water ball structure which has a small chance of malfunctioning.

In accordance with the present invention, there is provided a water ball structure comprising a base defining a cylindrical housing to received therein a music box type driving device and support thereon a water ball. The driving device is fixed on a disk which is received within a bottom opening of the housing and snap-held by resilient paws formed on the housing. A circumferential wall is provided to fix to and concentrically surround the housing. A rotation ring is supported on the circumferential wall by means of a ball bearing arranged on the top of the wall so as to allow the rotation ring to be rotatable relative to the housing in a concentric manner by being driven by the driving device through a gear train coupling therebetween. A toothed ring is fit over the housing and snap-held by paws provided on the housing. A number of motion generation devices are provided on the rotation ring, each having a first gear rotatably supported by an output shaft on the rotation ring and a second gear mating between the first gear and the toothed ring so that when the rotation ring rotates about the cylindrical housing, the output shaft of the first gear generates a rotation output through the engagement of the second gear with the toothed ring. A ball support collar is fit into the housing and snap-held by paws formed on the housing to support the water ball.

BRIEF DESCRIPTION OF THE DRAWINGS

The present invention will be better understood from the following description of preferred embodiments thereof, with reference to the attached drawings, wherein.

DETAILED DESCRIPTION OF THE PREFERRED EMBODIMENT

Figure 1:
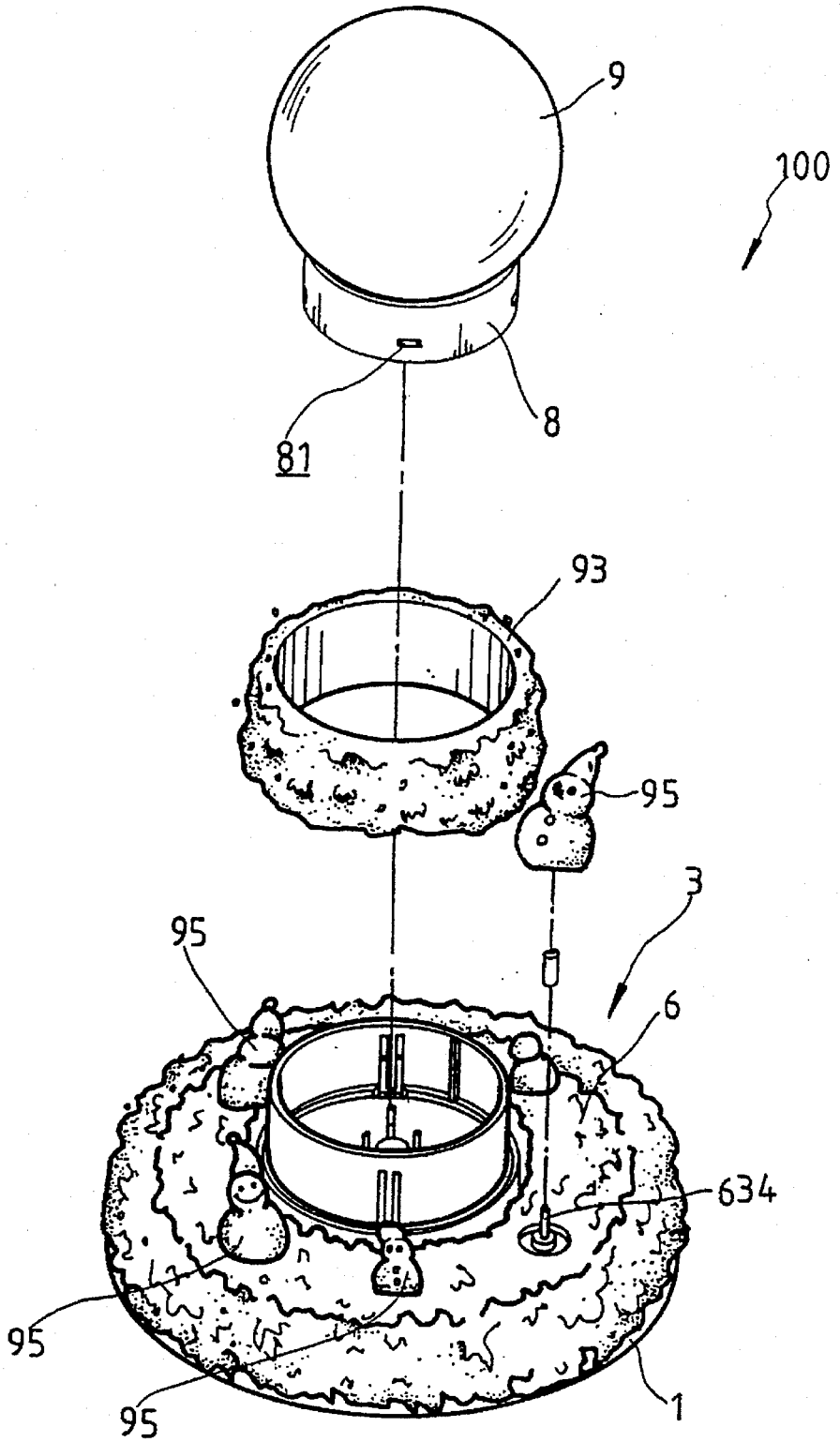
FIG. 1 is an exploded perspective view showing a water ball structure in accordance with the present invention.
Figure 2:
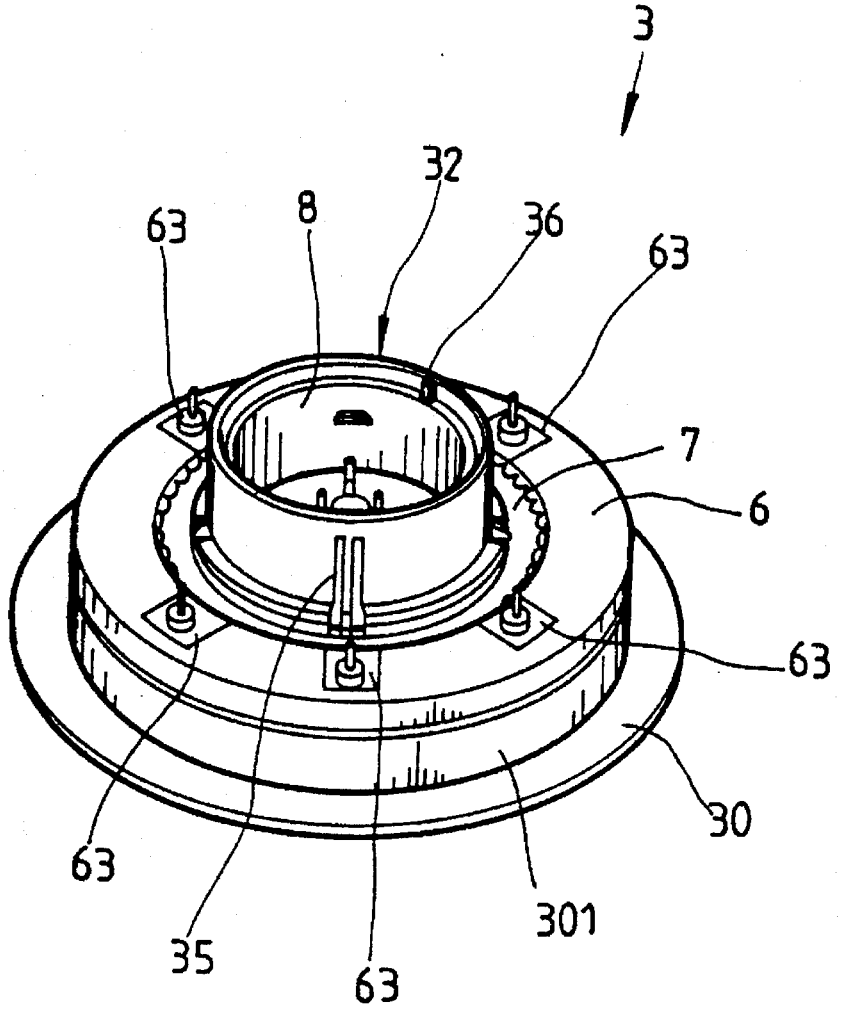
FIG. 2 is a perspective view showing the base structure adapted in the water ball of the present invention.
Figure 3A:
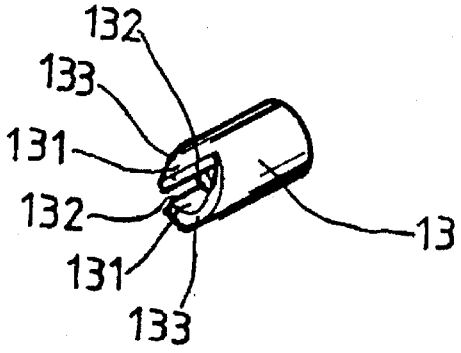
FIG. 3A is an enlarged view of the portion marked 3A in FIG. 3.
Figure 3:
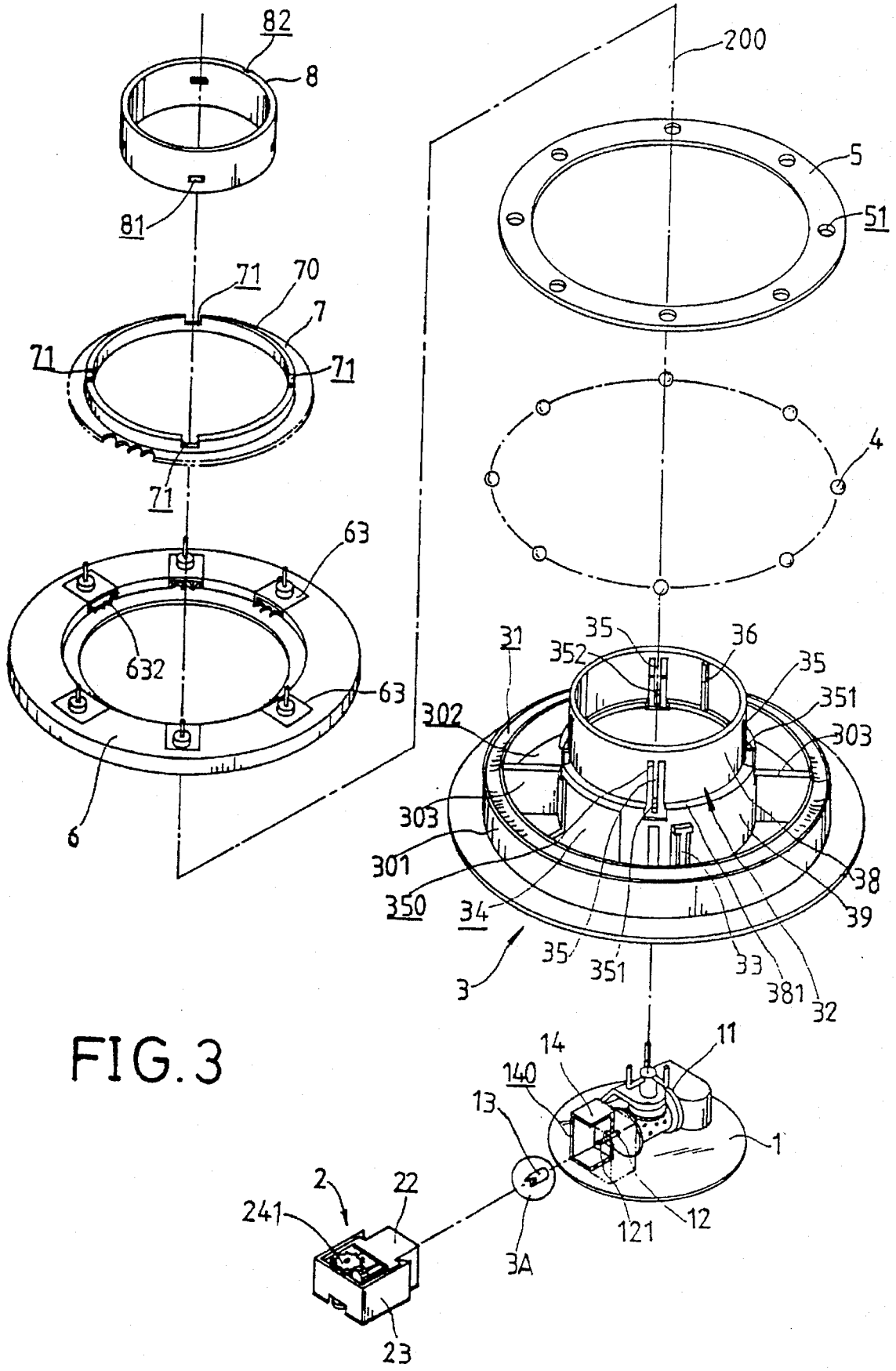
FIG. 3 is an exploded perspective view of the base of the water ball of the present invention.

With reference to the drawings and in particular to FIG. 1, wherein a water ball constructed in accordance with the present invention, generally designated with the reference numeral 100, is shown, the water ball 100 comprises a ball body 9 rotatably supported on a base 3 which is best shown in FIGS. 2 and 3. Decorative articles, such as a decorative ring 93 and dolls 95 may be suitably mounted on outside surface of the water structure 100 to enhance the effectiveness of decoration.

Figure 6:
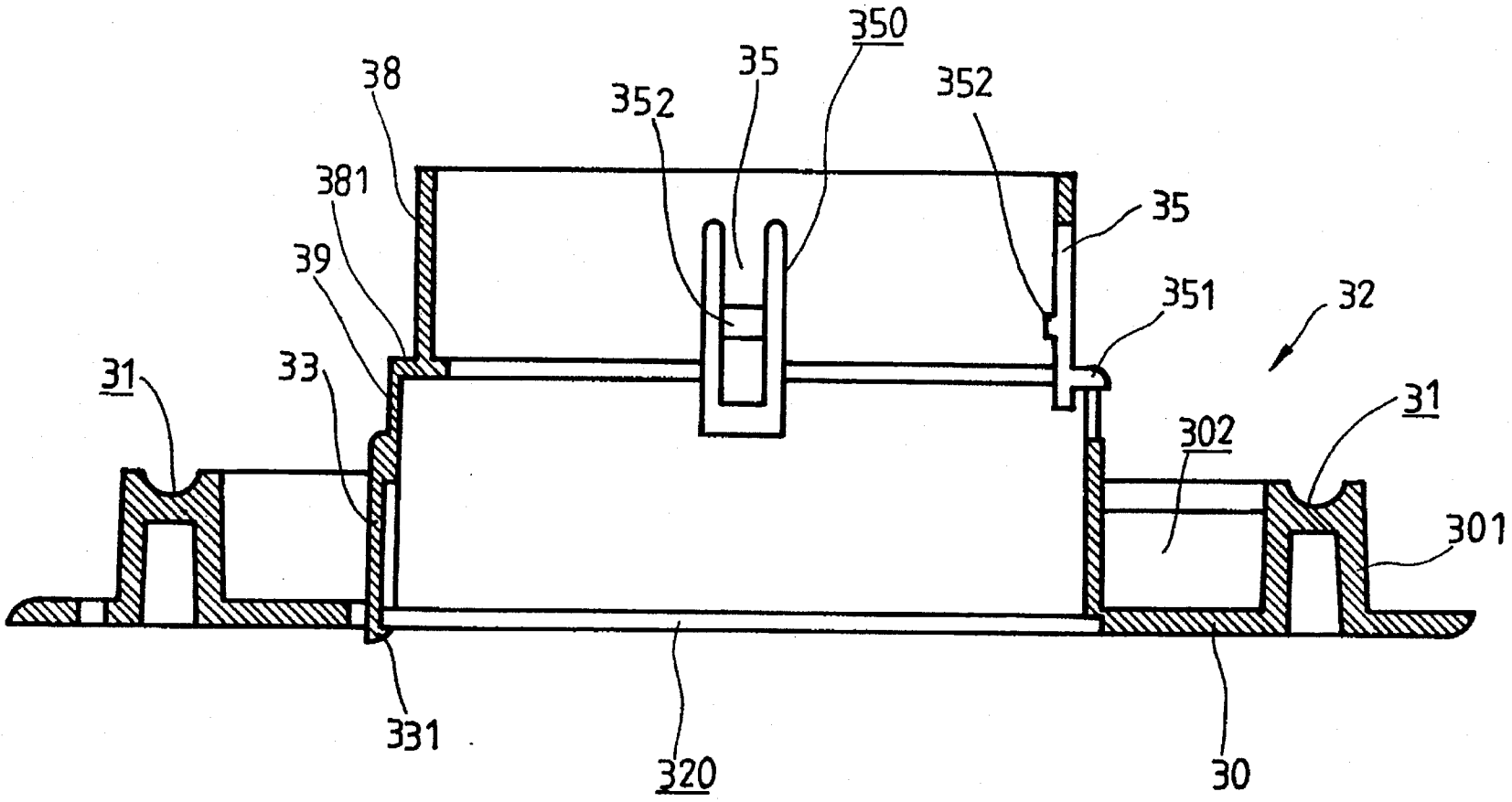
FIG. 6 is a cross-sectional view showing the housing of the base of the water ball of the present invention.
Figure 8:
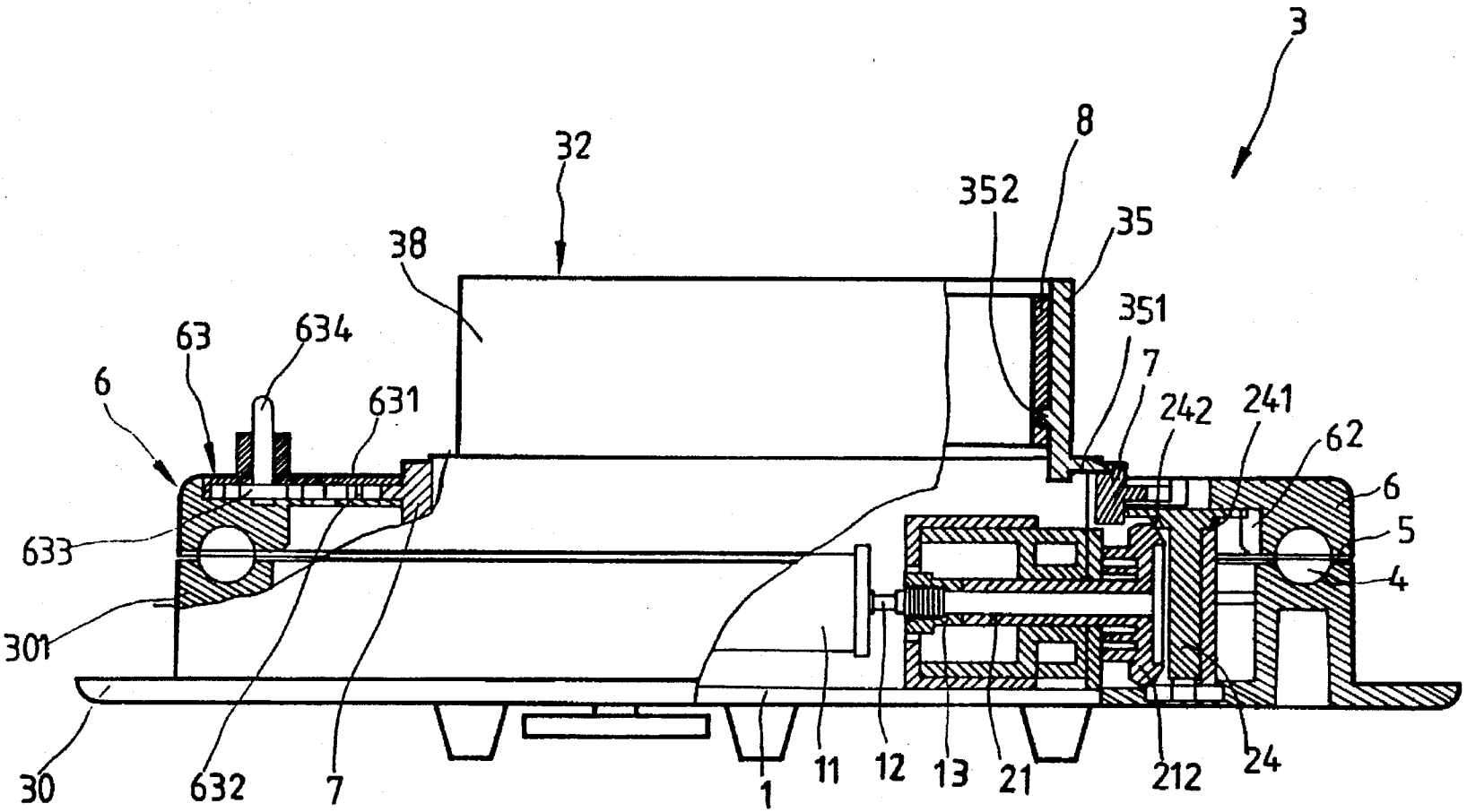
FIG. 8 is a perspective view of the base, partially broken to show inside structure thereof.

With further reference to FIG. 2, 3 and 8, wherein the base 3 is shown in more detail, the base 3 comprises a hollow cylindrical housing 32, also see FIG. 6, having a central axis 200 (FIG. 3). The housing 32 comprises an upper section 38 and a lower section 39 having a diameter greater than the upper section 38 so as to define a circumferential shoulder 381 around the upper section 38. A ring-like base plate 30 radially extends from and surrounds the lower end of the lower section 39. A raised circumferential wall 301 is formed on the base plate 30 to be spaced from and concentrically surrounding the lower section 39 of the housing 32 so as to define a ring-like spacing 302 therebetween. Radial webs 303 may provided between the lower section 39 and the wall 301 to securely support the wall 301. A groove 31 having semi-circular cross section is provided on top side of the wall 301 and extending along the wall 301 to serve as a lower race of bearing means to be described hereinafter.

The cylindrical housing 32 has a bottom opening 320 (FIG. 6) into which a disk 1, complemental in shape, is received. The disk 1 supports thereon driving means 11, which is preferably the driver means generally adapted in a musical box that is powered by tightened coil spring (not shown) to generate music and motion, as is well known in the art of music box, so as to have the driving means 11 housed in the hollow cylindrical house 32. The lower section 39 of the housing 32 is provided with a side opening 34 to communicate with the interior of the housing 32 through which a gear train device 2 that is located within the ring-like spacing 302 between the raised wall 301 and the lower section 39 is partially received to be engaged and thus driven by the driving means 11. The driving means 11 and the gear train device 2 will be further discussed.

The lower section 39 of the housing 32 is provided with a plurality of first retaining arms 33, each having an inward-facing paw 331 formed on lower end thereof to engage a circumferential edge of the disk 1 so as to hold the disk 1 within the bottom opening 320 of the lower section 39. The first retaining arms 33 are preferably made resilient so as to be deformable in engaging the disk 1 and securely holding the disk 1.

Figure 7:
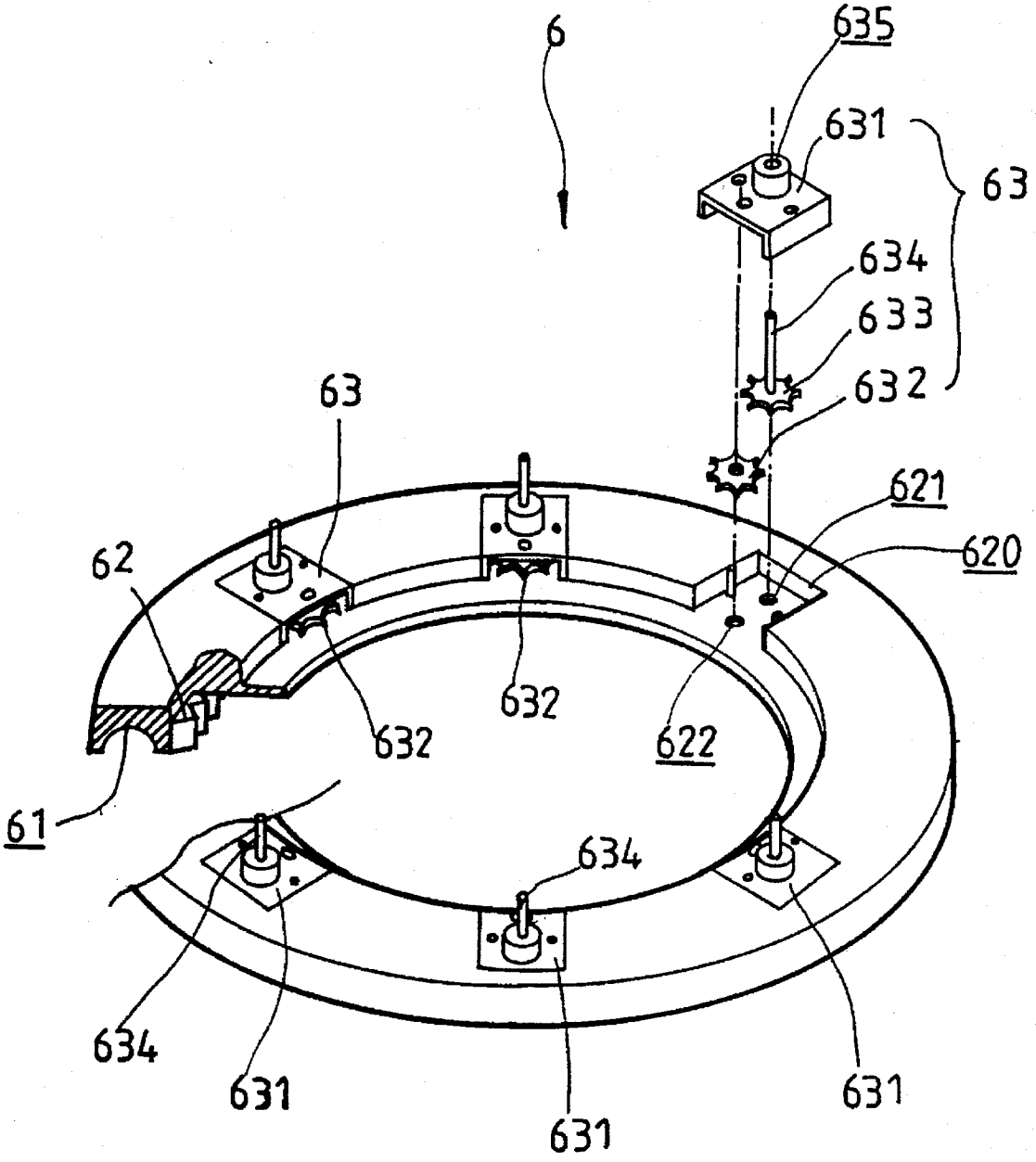
FIG. 7 is a perspective view, partially broken and exploded, showing a rotation ring adapted in the water ball of the present invention.

The raised wall 301 concentrically supports thereon a rotation ring 6, best seen in FIG. 7. A circumferential groove 61 of semi-circular cross section is formed on underside of the rotation ring 6, corresponding to the lower race 31 provided on the raised wall 301 to serve as an upper race of the bearing means. A plurality of spherical members 4 are received between the upper and lower races 61 and 31 to complete the construction of the bearing means. Thus the rotation ring 6 is allowed to freely rotate about the central axis 200 of the housing 32.

The bearing means may comprises a retainer ring 5 interposed between the upper race 61 of the rotation ring 6 and the lower race 31 of the raised wall 301. The retaining ring 5 has a plurality of holes 51 to each receive therein one of the spherical members 4 so as to retain the spherical members 4 within the upper and lower races 61 and 31.

A toothed ring 7 is fit onto the upper section 38 of the housing 32 and supported on the circumferential shoulder 381 of the housing 32. The toothed ring 7 has gear teeth 72 formed along an outer circumference thereof and a raised flange 70 formed along an inner circumference thereof. The housing 32 has a plurality of second retaining arms 35 provided on the upper section 38 thereof. Each of the second retaining arms 35 comprises an elastically deformable tab arranged within an opening 350 formed on the upper section 38 with a first paw 351 and a second paw 352 provided thereon to respectively face outward and inward. The outward facing paws 351 of the second retaining arms 35 are arranged to fit into notches 71 formed on the inner flange 70 of the toothed ring 7 so as to securely fix the toothed ring 7 on the housing 32 and relative movement between the toothed ring 7 and the housing 32 is thus prohibited.

The rotation ring 6 has an inner toothed circumference 62 engageable by an output pinion 241 of the gear train device 2 so as to have the rotation ring 6 driven by the driving means 11 through the gear train device 2 to rotate about the central axis 200. The rotation ring 6 is also provided with a plurality of motion generation devices 63, each comprising a first gear 633 fixed on an output shaft 634 which is rotatably supported on the rotation ring 6 by means of a holder member 631 that has a bore 635 through which an upper end of the output shaft 634 is rotatably received to project outside the holder member 631. A second gear 632 is also rotatably supported on the rotation ring 6 by means of the holder member 631 and matingly engageable between the first gear 633 and the toothed ring 7 so as to define a planetary gear system which allows the first gear 633 and thus the output shaft 634 of the motion generation device 63 to be driven by the toothed ring 7 to rotate about the shaft 634 when the rotation ring 6 is rotated by the driving means 11.

Each of the output shafts 634 of the motion generation devices 63 is adapted to receive and support thereon a doll 95 (FIG. 1) so that when the water ball structure 100 of the present invention is actuated, the dolls 95 that are supported on the output shafts 634 rotate.

Preferably, the rotation ring 6 is provided with a plurality of recessed sections 620 and the holder members 631 are in the form of an inverted U shape to be tightly fit into and thus held within the recessed sections 620. Each of the recessed sections 620 is provided with two holes 621 and 622 to rotatably support the first and second gears 633 and 632 of the respective motion generation devices 63.

A ball support collar 8 that is provided to support the ball body 9 (FIG. 1) is dimensioned to fit into the upper section 38 of the housing 32 and retained therein by means of engagement of the second paws 352 of the second retaining arms 35 with slots 81 provided on the collar 8. A positioning rib 36 may be provided on an inside surface of the upper section 38 to engage a slot 82 (FIG. 3) for positioning the collar 8 relative to the upper section 38 of the housing 32.

Back to FIG. 3, the driving means 11 comprises an output spindle 12 driven by the coil spring (not shown) of the music box mechanism with a coupling member 13, best seen in FIG. 3A, fixed thereon preferably by means of threading 121 formed on the output spindle 12. A connecting casing 14, preferably a box-like casing, is provided on the disk 1 to house the coupling member 13 therein with a front opening 140 (FIG. 3) provided for the access of the coupling member 13.

Also referring to FIG. 3A in which an expanded view of the coupling member 13 is shown, the coupling member 13 is a tubular member having a toothed end on which two teeth 131 are provided to extending axially with the tubular member. Each of the teeth 131 comprises a straight side 132 and an inclined side 133 meeting at an apex distant from the tubular member. The straight side 132 of one of the teeth 131 and the inclined side 133 of the other tooth 131 define a recess between the two teeth 131.

Figure 4:
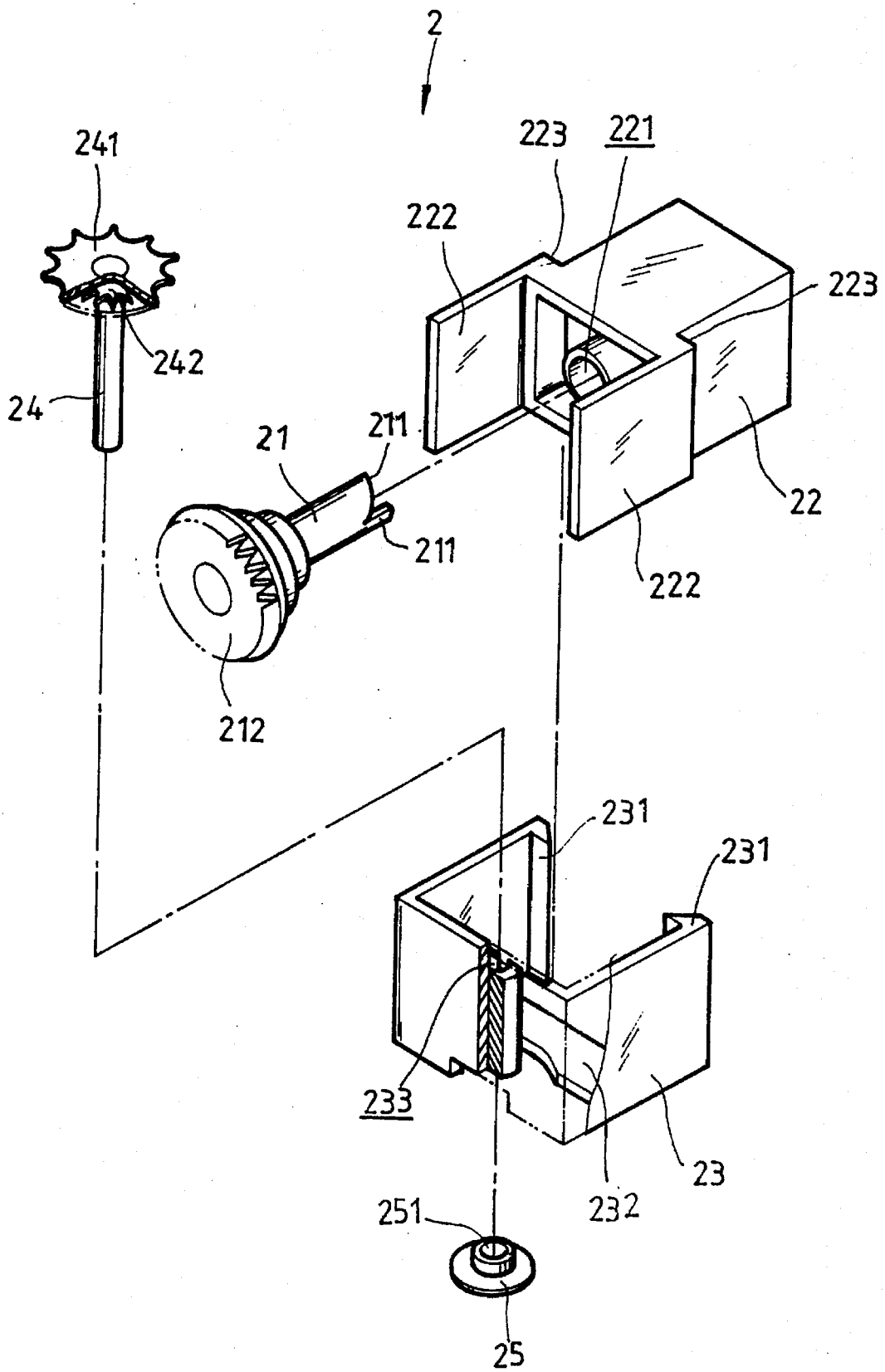
FIG. 4 is an exploded perspective view showing a driving mechanism incorporated in the base of the water ball of the present invention.

Further referring to FIG. 4 wherein an exploded perspective view of the gear train device 2 is shown, the gear train device 2 comprises a holder 22 having an end dimensioned and configured to be fit into and held in the connecting casing 14 through the front opening 140. Two side plates 222 are provided to extend from the holder 22, each defining a shoulder 223 with the holder 22. A central bore 221 is provided in the holder 22 into which a shaft 21 is rotatable received. The shaft 21 has a first end having two teeth 211 provided thereon to be corresponding to and engaged by the teeth 131 of the coupling member 13 for the transmission of rotation from the output spindle 12 of the driving means 11 to the shaft 21. The shaft 21 has a second end to which a first bevel gear 212 is mounted to be rotatable in unison therewith.

A second, U-shaped holder 23 is provided with two paw sections 231 to engage the shoulders 223 of the first holder 22 in such a manner to define therebetween a space for receiving therein a second bevel gear 242. A stop plate 232 may be provided on the second holder 23 to retain the first holder 22 on the second holder 23.

The second holder 23 is provided with a bore 233 in which an axle 24 is rotatably received and retained by means of a journal member 25. The second bevel gear 242 is fixed on the axle 24 and engageable with the first bevel gear 212 so as to drive the axle 24 by means of the gear mating between the two bevel gears 212 and 242. The output pinion 241 of the gear train device 2 is fixed on the axle 24 to be rotatable in unison therewith. The output pinion 241 is arranged to be engageable with the inner toothed circumference 62 of the rotation ring 6, as mentioned previously.

Figure 5:
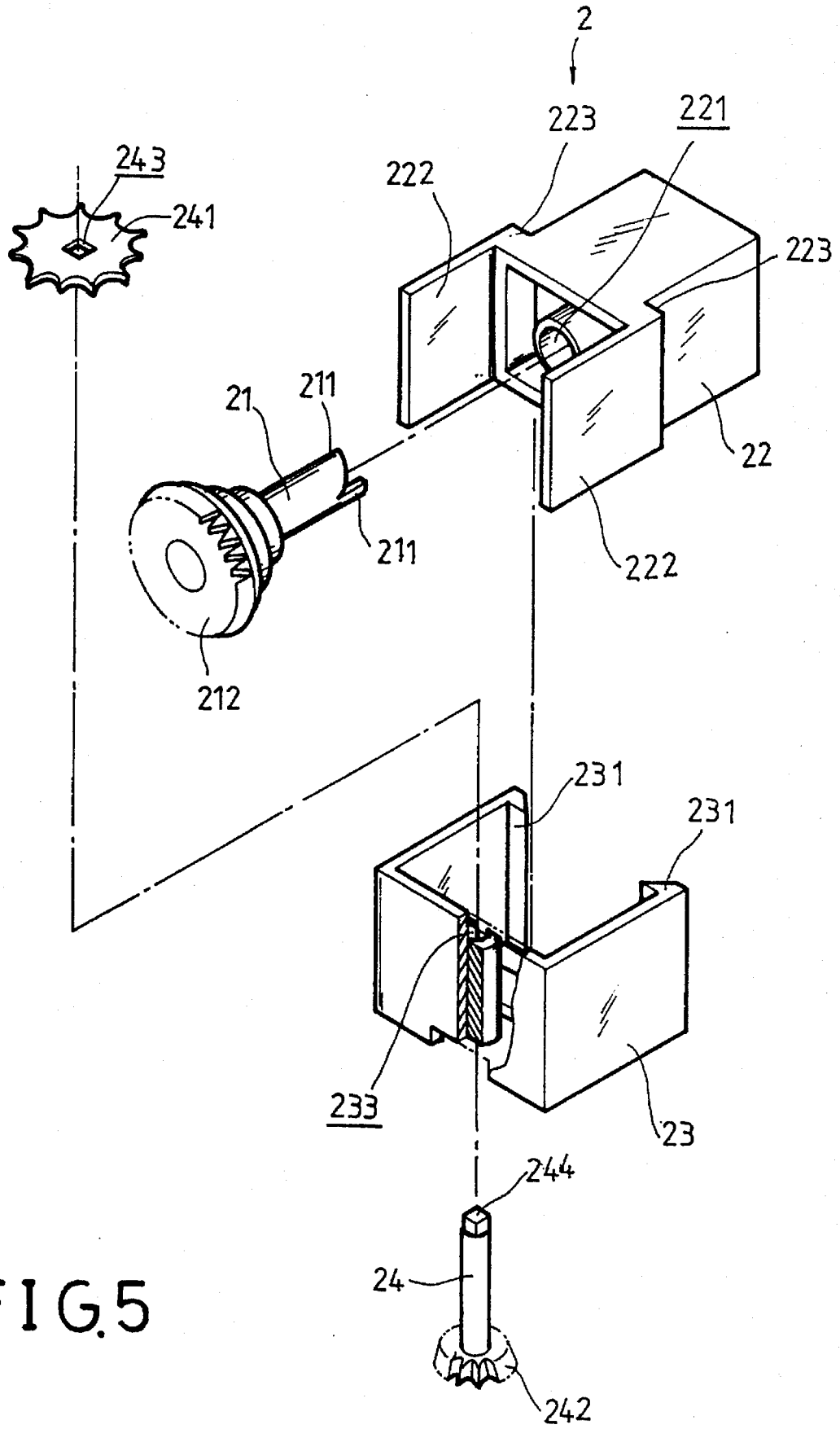
FIG. 5 is an exploded perspective view showing a different arrangement of the driving mechanism to be incorporated in the base of the water ball of the present invention.

In FIG. 5, a second embodiment of the engagement between the first bevel gear 212 and the second bevel gear 242 is shown, wherein the second bevel gear 242 is so engaged by the first bevel gear 212 as to rotate in a direction opposite to that of the embodiment shown in FIG. 4. Also, in the second embodiment illustrated in FIG. 5, the output pinion 241 is attached to the axle 24 in a removable manner wherein the axle 24 is provided with a square end 244 and the output pinion 241 is provided with a central square hole 243 to be drivingly fit onto the square end 244 of the axle 24.

Figure 9:
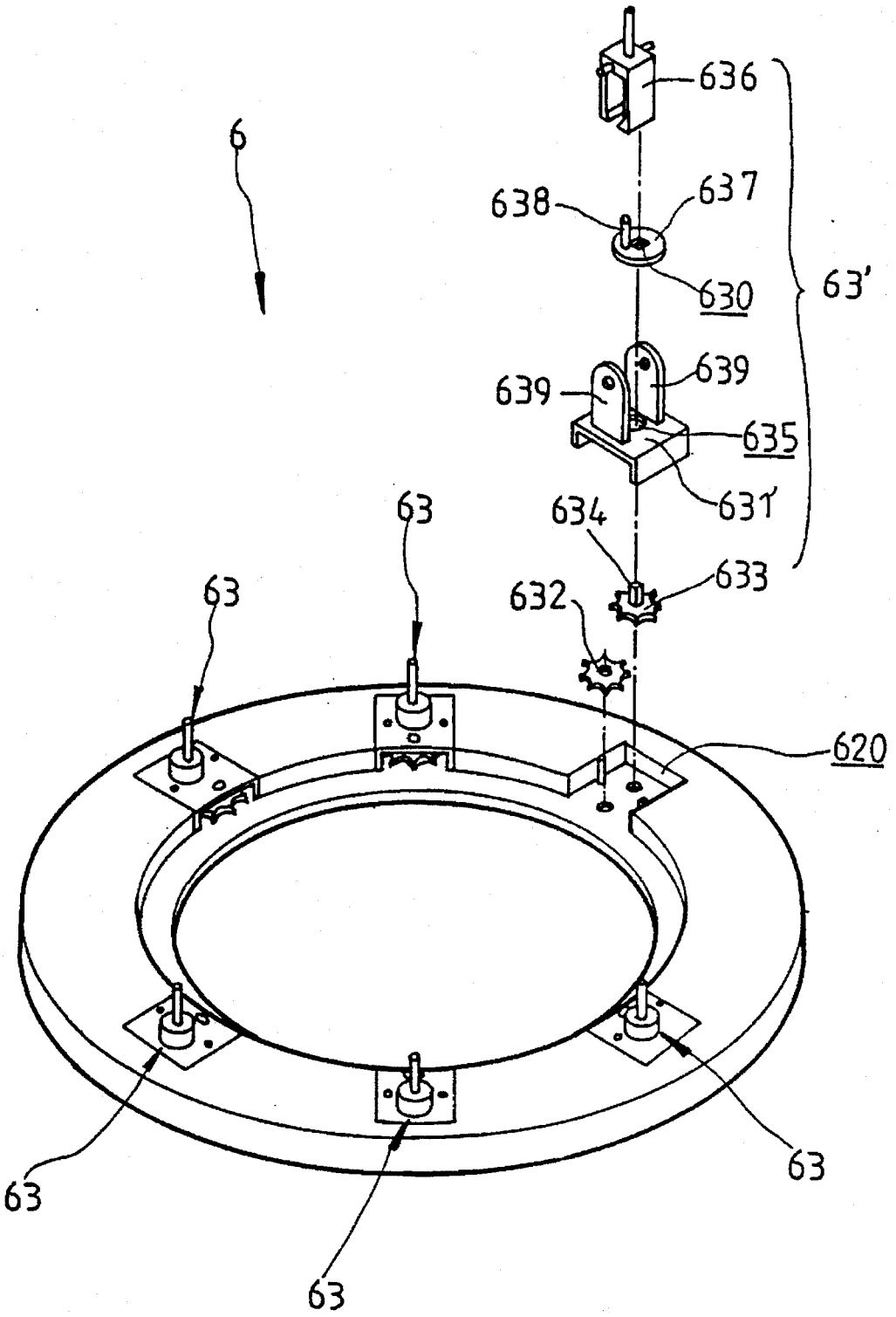
FIG. 9 is a perspective view, partially broken and exploded, showing a second embodiment of the rotation ring that is incorporated in the water ball of the present invention.

In FIG. 9, a modification of the motion generation devices 63 that are disposed on the rotation ring 6 and most clearly illustrated in FIG. 7 is shown. The modified motion generation devices which are designated with reference 63' in FIG. 6 are also arranged on the rotation ring 6 and driven by being engaged with the toothed ring 7. Each of the modified motion generation devices 63' comprises a first gear 633 and a second gear 632 mating between the toothed ring 7 and the first gear 633. The gears 633 and 632 and rotatably supported between a recessed section 620 and a U-shape holder member 631' that is tightly fit into the recessed section 620. The first gear 633 has a shaft 634 with a square end extending out of a bore 635 formed on the holder member 631'. A disk 637 has a central square hole 630 drivingly fit onto the square end of the shaft 634 to be rotatable in unison therewith. The disk 637 also has a post 638 offset from the central hole 630 of the disk 637 so as to orbit about the central hole 630 when the disk 637 is rotated.

A rocking member 636 in the form of a U shape is pivoted to two opposing walls 635 fixed on the holder member 631 to have the offset post 638 received therein so that when the post 638 orbits the central hole 630 of the disk 637, the two limbs of the U shape of the rocking member 636 are alternately engaged by the post 638 and thus making the rocking member 636 rocks about its pivotal connection with the walls 635. With such a modified motion generation device 63', a teetering motion can be generated by mounting a teetering board 96 thereon, see FIG. 10 in which a second embodiment of the water ball structure in accordance with the present invention is shown and designated with the reference numeral 400.

Figure 10:
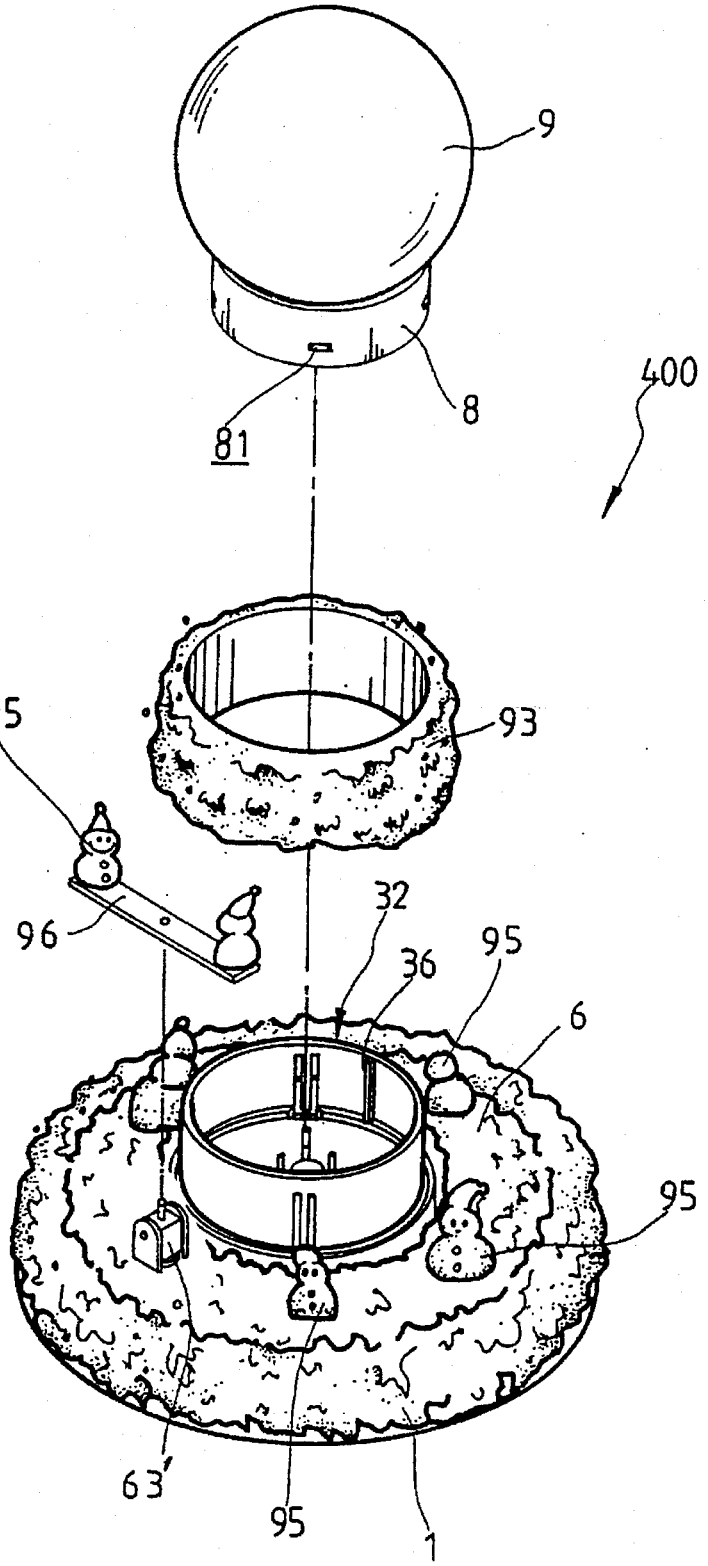
FIG. 10 is an exploded perspective view showing a water ball structure of the present invention incorporating the second embodiment rotation ring shown in FIG. 9.

To provide a more attractive decoration, a decorative ring 93, see FIGS. 1 and 10, can be fit over the upper section 38 and the lower section 39 and the raised circumferential wall 301 may also be covered or shielded by decorative coatings.

Although preferred embodiments have been described to illustrate the present invention, it is apparent that changes and modifications in the specifically described embodiments can be carried out without departing from the scope of the invention which is intended to be limited only by the appended claims.

What is claimed is:

1. A water ball structure comprising a ball body supported on a holder, wherein the holder comprising:

a base, comprising a hollow cylinder having lower opening and upper opening to define therein an interior space extending along a central axis, a ring section radially extending from a lower end of the cylinder with a raised wall formed thereon to concentrically surround the cylinder;

driving means mounted on a disk which is received and retained within the lower opening of the cylinder by means of first retaining arms fixed on the cylinder and having paws to engage and thus hold the disk so as to have the driving means housed within an interior space of the cylinder;

bearing means comprising an upper race, a lower race formed on a top edge of the raised wall and a plurality of spherical members rollingly received between the upper and lower races and retained therein;

a rotation ring concentrically supported on the raised wall by means of the bearing means and mechanically coupled to the driving means to be driven to rotate about the central axis; and a plurality of motion generation devices mounted on the rotation ring to generate motion during the rotation of the rotation ring driven by the driving means.

2. The water ball structure as claimed in claim 1, wherein the driving means comprises a music box mechanism having an output spindle to provide a rotation output and wherein mechanical coupling means is provided to mechanically couple the output spindle to the rotation ring.

3. The water ball structure as claimed in claim 2, wherein the mechanical coupling means comprises a first bevel gear coupled to the output spindle by means of connection means to be driven thereby and a second bevel gear supported on an rotatable axle and in engagement with first bevel gear to transmit the rotation of the output spindle to the axle of the second bevel gear on which an output pinion is mounted to be engageable by an inner toothed circumference formed on the rotation ring.

4. The water ball structure as claimed in claim 3, wherein the mechanical coupling means comprises a casing partially extending through an opening formed on the cylinder into the interior space of the cylinder to be tightly received and retained within a box-like holder that is fixed on the disk and having a front opening through which the casing is inserted, a central bore being formed inside the casing to rotatably receive therein a shaft of the first bevel gear to connect to the output spindle, the casing having two side plates extending therefrom to each define a shoulder with the casing, a U-shaped member having two limbs each having an end with a paw formed thereon to engage the shoulder of the casing so as to fix to the casing, the U-shaped member and the two side plates of the casing defining therein a space for accommodating the second bevel gear, the U-shaped member having a bore formed therein to rotatably receiving therein the axle of the second bevel gear.

5. The water ball structure as claimed in claim 4, wherein the casing comprises a stop plate formed between the two side plates to support and hold the U-shaped member on the casing.

6. The water ball structure as claimed in claim 3, wherein the connection means that couples the first bevel gear to the output spindle of the driving means comprises a tubular member fit over and fixed on the output spindle, the tubular member having two teeth extending in a direction parallel with an axis of the output spindle, each teeth having a straight side and an inclined side, the first bevel gear having a shaft that has an end adjacent to the teeth of the output spindle with two teeth formed thereon, each of the teeth of the shaft of the first bevel gear also comprising a straight side and an inclined side so as to have the straight sides of the teeth of the first bevel gears to engage the straight sides of the teeth of the tubular member to establish mechanical coupling therebetween.

7. The water ball structure as claimed in claim 1, wherein each of the motion generation device comprises a gear train having a first gear rotatably supported on the rotation ring by means of an output shaft and a second gear in engagement with the first gear and wherein a toothed ring is fit over and fixed on the cylinder to be in engagement with the second gear so that when the rotation ring rotates, the output shaft is driven to rotate by the engagement between the second gear and the toothed ring and orbit about the central axis of the cylinder.

8. The water ball structure as claimed in claim 7, wherein the toothed ring has a raised inner flange on which a plurality of notches are formed, the cylinder having a number of second retaining arms formed thereon, each of the second retaining arms having a first paw formed thereon to engage the notches of the toothed ring and thus securely fix the toothed ring on the cylinder.

9. The water ball structure as claimed in claim 8, wherein the cylinder comprises a circumferential shoulder to support the toothed ring thereon.

10. The water ball structure as claimed in claim 7, wherein each of the motion generation devices comprises a U-shaped member tightly fit into a recessed section formed on a top surface of the rotation ring, the first and second gears of the gear train of the motion generation device being rotatably supported between the U-shaped member and the recessed section.

11. The water ball structure as claimed in claim 10, wherein the rotation ring has an under surface, opposite to the top surface on which the recessed sections are formed, the upper race of the bearing means being formed on the under surface of the rotation ring to be opposite to the lower race formed on the raised wall that surrounds the cylinder of the base.

12. The water ball structure as claimed in claim 10, wherein the U-shaped member comprises a hole to allow an end portion of the output shaft to extend outward therethrough.

13. The water ball structure as claimed in claim 12, wherein the motion generation device further comprises a rotating disk fixed to the end portion of output shaft so as to be rotatable with the output shaft to have an offset post extending from the rotating disk to orbit about the output shaft and a teetering mechanism having a rocking member having a U shape pivotally supported by two opposing walls extending from the U-shaped member that is fit into the recessed section to receive the offset post within the rocking member so that when the offset post orbits about the output shaft, two opposing limbs of the rocking member are alternately engaged by the offset post and thus rocking the rocking member about a pivot, a teetering board being supported on the rocking member.

14. The water ball structure as claimed in claim 1, further comprising a ball support collar fit into the interior space of the cylinder through the upper opening for supporting thereon the ball body, the collar having a plurality of slots formed thereon to be engaged by paws provided on the cylinder for fixing the collar inside the cylinder.

15. The water ball structure as claimed in claim 1, further comprising a ball support collar fit into the interior space of the cylinder through the upper opening for supporting thereon the ball body, the collar having a plurality of slots formed thereon and wherein second retaining arms of the cylinder comprise second paws to engage the slots of the collar so as to fix the collar inside the cylinder.

16. The water ball structure as claimed in claim 1, wherein the bearing means comprises a retainer ring interposed between the upper race and the lower race, the retainer ring having a plurality of holes to receive and retain therein the spherical members.

17. The water ball structure as claimed in claim 1, wherein the rotation ring has an under surface on which the upper race of the bearing means is formed.

* * * * *